US006561852B2

(12) United States Patent
Lo

(10) Patent No.: US 6,561,852 B2
(45) **Date of Patent: *May 13, 2003**

(54) ADAPTER FOR CONNECTING RJ-45 PORT AND RJ-11 PORT

(75) Inventor: Li-Chih Lo, Taipei-Hsien (TW)

(73) Assignee: ASUSTek Computer Inc., Taipei (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/475,012

(22) Filed: Dec. 30, 1999

(65) Prior Publication Data

US 2002/0001998 A1 Jan. 3, 2002

(30) Foreign Application Priority Data

Nov. 15, 1999 (TW) ..... 88119830 A

(51) Int. Cl.[7] ..... H01R 25/00
(52) U.S. Cl. ..... 439/638
(58) Field of Search ..... 439/502, 676, 439/638, 628

(56) References Cited

U.S. PATENT DOCUMENTS 4,362,905 A * 12/1982 Ismail ..... 439/676
5,328,390 A * 7/1994 Johnston et al. ..... 439/676
5,666,408 A * 9/1997 Lao ..... 439/676

* cited by examiner

*Primary Examiner*—Tulsidas Patel
(74) *Attorney, Agent, or Firm*—Rabin & Berdo, P.C.

(57) ABSTRACT

An adapter for connecting an RJ-45 port and an RJ-11 port consists of at least an RJ-45 port and at least an RJ-11 port. The RJ-45 port is for connecting an RJ-45 device which uses an RJ-45 connector while the RJ-11 port is for connecting an RJ-11 device which uses an RJ-11 connector, and the RJ-45 port can be electrically coupled with the RJ-11 port.

21 Claims, 3 Drawing Sheets

ADAPTER FOR CONNECTING RJ-45 PORT AND RJ-11 PORT

CROSS-REFERENCE TO RELATED APPLICATION

This application claims the priority benefit of Taiwan application serial no. 88119830, filed Nov. 15, 1999.

BACKGROUND OF THE INVENTION

1. Field of the Invention

This invention relates to an adapter, and more particularly to an adapter for connecting an RJ-45 port and an RJ-11 port.

2. Description of Related Art

The hardware of the personal computer has been becoming cheaper and cheaper nowadays, accordingly, the supporting software has been diversified. In addition to the general data processing, the functions of processing on video, audio, and image are gradually enhanced which signify the sign of the advent of a multimedia age. Although the functions of the multimedia personal computer are integrated and independent, in order to share the resources with one another, it becomes necessary to connect them to the computer network to give each of the personal computers a full play on their functions.

The information transmission on the network can go through a lot of various kinds of ports and different types of wire connections to connect to the facilities and devices having different types of functions, and further to attain the object of an effective information transmission. Among them, the different types of ports and wire connections comprise at least a twisted pair RJ-45 port of the category 5 or category 3 for use in the network, and a twisted pair RJ-11 port for connecting to the telephone lines.

Following the rapid development of the various kinds of devices on the network, quite a high percentage of them employ twisted pair RJ-45 devices and twisted pair RJ-11 devices. For instance, the network interface card generally employs RJ-45 twisted pair while the modem employs RJ-11 twisted pair. In the light of these various kinds of wire connections and transmitted data by different type of connectors, a chip set that can share these two different types of data has been provided for mass production.

The only portion of the conventional way of disposition of the connectors is RJ-45 connector to RJ-45 connector, or RJ-11 connector to RJ-11 connector wherein these connectors are either male-to-female, or male-to-male, or female-to-female transferred connections. Therefore, although data can be transferred to one another, predicaments can occur when the connectors can not match one another. However, if the hardware design takes into consideration on the space reserved for accommodating various types of adapters, the size of the hardware will become very large. If one considers not to increase the size of the hardware but to omit some of the original connectors in order to add these connectors for transmitting data for the network and the telephone line etc., then some of the functions of the hardware will have to be diminished. Besides, this kind of design on changing functions of hardware is not an ideal design anyway.

To summarize the above-mentioned statement, the conventional disposition of the connectors has the following disadvantages:

1. The conventional disposition of the connectors can only change the male and female types of connectors but can not transfer between the RJ-45 wire connection into the RJ-11 wire connection.

2. When it comes to employing a lot more different kinds of wire connection, the size of the hardware of the conventional disposition of the connectors will become relatively large which will result in a jam-up of the internal hardware or the circuit of the computer.
3. If one decides not to change the size of the hardware while intending to add new connectors, the conventional disposition of the connectors will have to remove the original connectors that will result in the loss of some of the original functions.

SUMMARY OF THE INVENTION

In the light of the foregoing disadvantages, the present invention provides an adapter for connecting an RJ-45 port and an RJ-11 port that can transfer the connection between RJ-45 and RJ-11. With this kind of adapter, the present invention does not have to increase the size of the hardware on the computer's internal hardware design. On the contrary, the present invention can omit the unnecessary design of connectors and can further increase the space available on the design of the internal hardware of a computer.

An adapter of the present invention for connecting a RJ-45 port and a RJ-11 port consists of at least an RJ-45 port and at least an RJ-11 port. The RJ-45 port is for connecting an RJ-45 device that uses an RJ-45 connector while the RJ-11 port is for connecting an RJ-11 device that uses an RJ-11 connector wherein the RJ-45 port is electrically coupled with the RJ-11 port. Among them, both the RJ-45 port and RJ-11 port can be either a male-connector or a female-connector. The RJ-45 device that uses RJ-45 connector consists of, for example, local area network (LAN) or internet while the RJ-11 device that uses RJ-11 connector consists of, for example, modem and Home Phone Line Networking Alliance (Home PNA).

In an embodiment of the present invention, the adapter can have an RJ-45 port electrically coupled with an RJ-11 port while in another embodiment of the present invention the adapter can have an RJ-45 port electrically coupled with a plurality of RJ-11 ports. Additionally, in one of the embodiment of the present invention, the adapter can have an RJ-11 port electrically coupled with a plurality of RJ-45 ports while in another embodiment of the present invention the adapter can have a plurality of RJ-45 ports electrically coupled with an RJ-11 port.

To summarize the above-mentioned statement, the present invention integrates different types of connectors to create an adapter. The adapter not only can transfer between the RJ-45 connection and the RJ-11 connection, but also can omit unnecessary connector design without increasing the size on the design of the computer's internal hardware, thereby, more space can be saved inside the computer and in those areas for placing connectors.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

Figure 1:
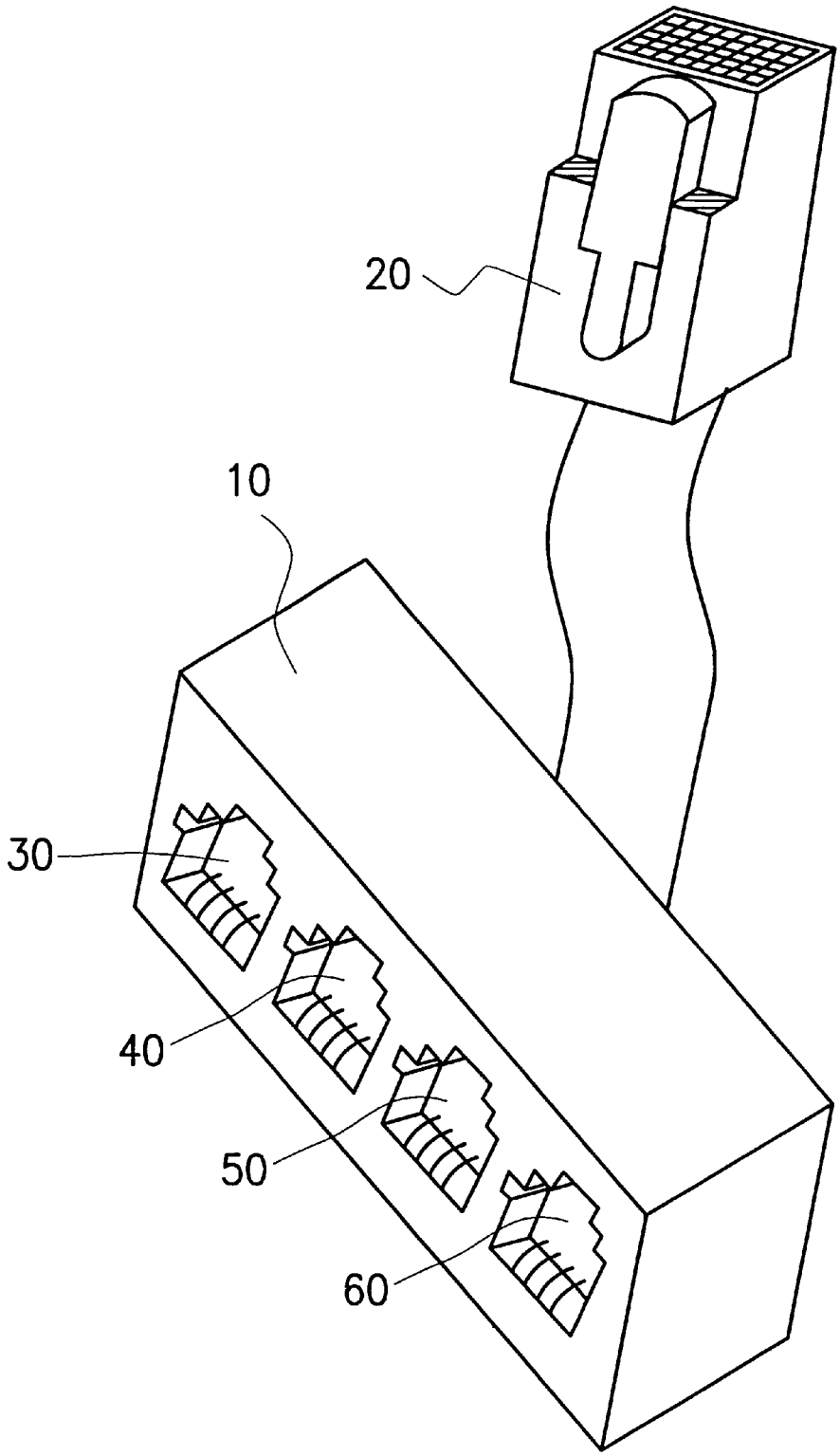
FIG. 1 is an isometric view of an adapter structure of a preferred embodiment according to the present invention.

FIG. 1 is an isometric view of an adapter structure of a preferred embodiment according to the present invention. As shown in FIG. 1, the adapter of the present embodiment comprises an RJ-45 male-connector 20 and four RJ-11 female-connectors 30, 40, 50, and 60. Generally, the RJ-45 wire connections and connectors are used in local area network (LAN) or internet while the RJ-11 wire connections and connectors are used in modem or Home Phone Line Networking Alliance (Home PNA).

Figure 2:
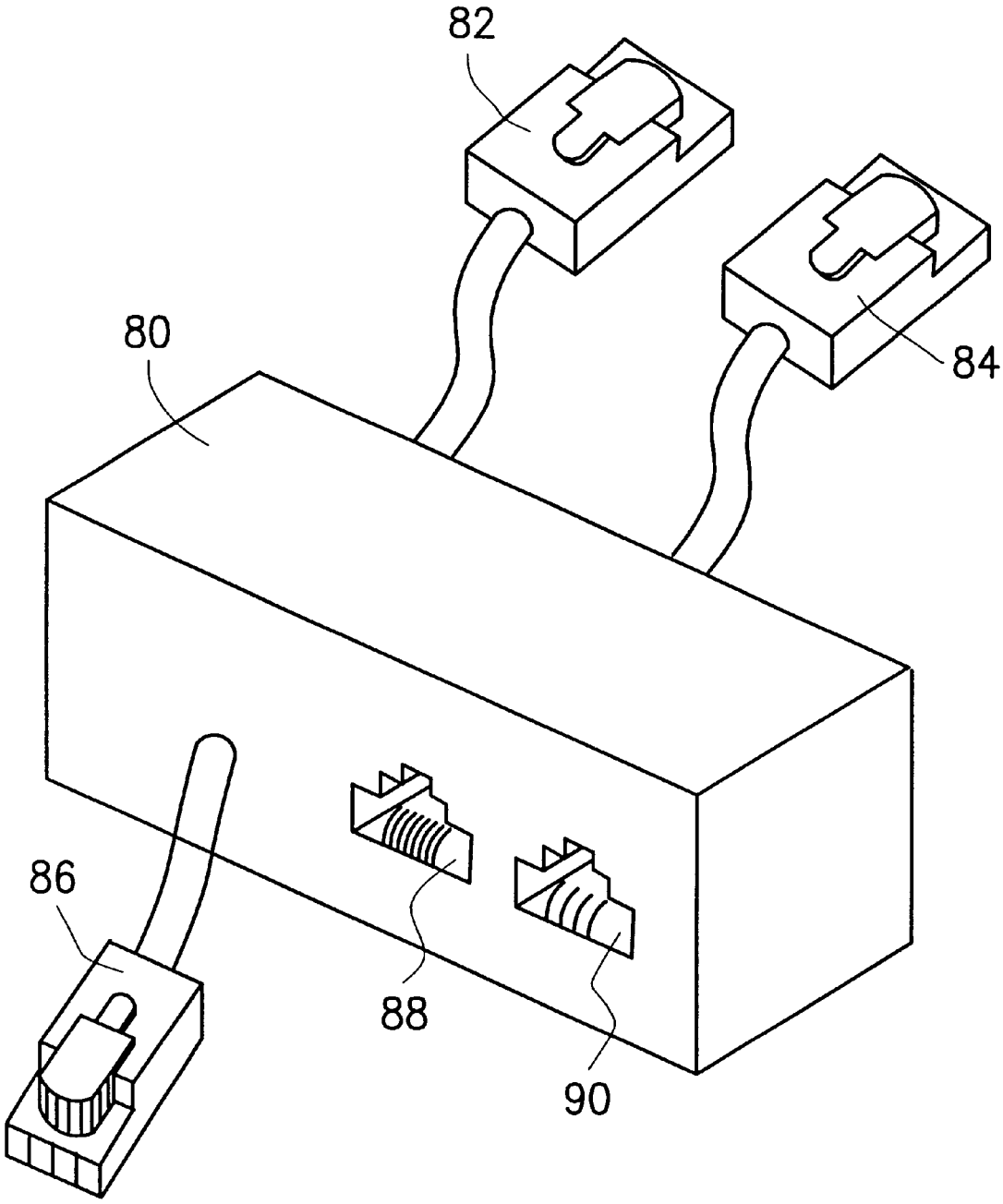
FIG. 2 is an isometric view of an adapter structure of another preferred embodiment according to the present invention.

Notice that the RJ-45 connectors are not limited to male-connectors, nor are the RJ-11 connectors are limited to female-connectors. Besides, the number and position of the connector are not limited to the number and position of the connector disclosed by the present embodiment. For instance, FIG. 2 is an isometric view of an adapter structure of another preferred embodiment according to the present invention. As shown in FIG. 2, the adapter 80 comprises an RJ-45 male-connector 82, an RJ-45 female-connector 88, two RJ-11 male-connector 84, 86, and an RJ-11 female-connector 90.

Figure 3:
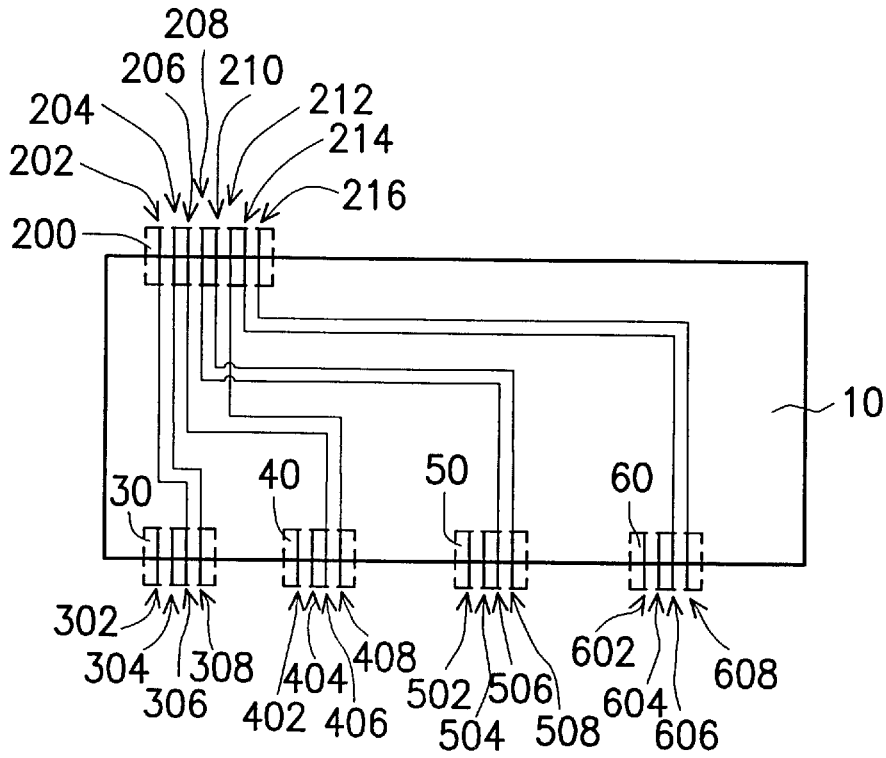
FIG. 3 is a schematic internal circuit diagram of an adapter structure of a preferred embodiment according to the present invention.

FIG. 3 shows a schematic internal circuit diagram of the adapter structure 10 shown in FIG. 1 of a preferred embodiment according to the present invention. In the network protocol of today, the method of data transmission of RJ-45 is to have the first and the second pins (i.e. pins 202, 204) as a set, the third and the sixth pins (i.e. pins 206, 212) as a set, the fourth and the fifth pins (i.e. pins 208, 210), as well as the seventh and the eighth pins (i.e. pins 214, 216) as a set. In general, the telephone line having RJ-11 wire connection employs only the third and the fourth pins (in FIG. 3, they are pins 306 and 308, pins 406 and 408, pins 506 and 508, pins 606 and 608) as a set for transmitting data. Therefore, the pin sets for transmitting data in the RJ-11 wire connection are used to connect respectively to the pin sets for transmitting data in the RJ-45 in order to attain the object of transferring data between RJ-45 connectors and RJ-11 connectors.

Figure 4:
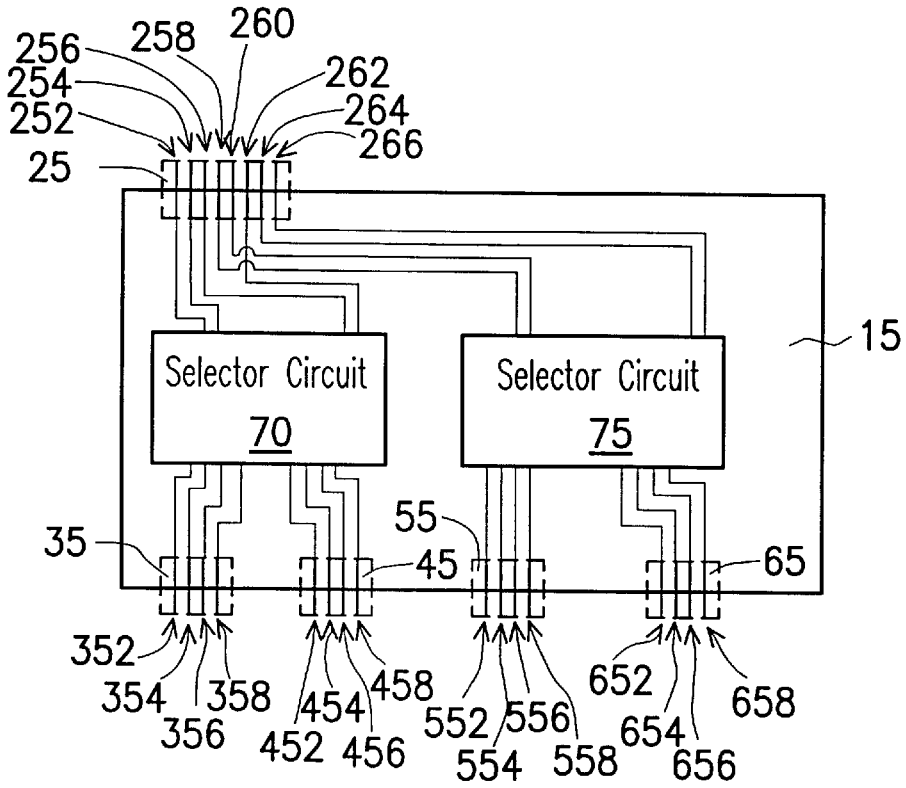
FIG. 4 is a schematic internal circuit diagram of an adapter structure of another preferred embodiment according to the present invention.

FIG. 4 is a schematic internal circuit diagram of an adapter structure of another preferred embodiment according to the present invention. In the method of the foregoing network communication, when it comes to data transmission by employing the RJ-45 wire connection, the first and the second pin set as well as the third and the sixth pin set are employed to transmit data. Therefore, in case the RJ-11 connection needs four pins to transmit data, data transfer can be performed by following the circuit shown in FIG. 4.

As shown in FIG. 4, the RJ-45 female-connector 25 has pins 252, 254, 256, 258, 260, 264, and 266. Under the circumstance that four pins are employed to perform data transmission, the wire connection has the pins 252, 254, 256, and 262 as a set while having the pins 258, 260, 264, and 266 as another set. In the present embodiment, any set of pins of the RJ-45 female-connector 25 can be employed to connect to two of the RJ-11 female-connectors (RJ-11 female-connectors 35 and 45 or RJ-11 female-connectors 55 and 65). It then decides when and to which one of an RJ-11 female-connectors to be connected by a set of pins of the RJ-45 female-connector 25 through the selector circuit 70 and 75 respectively.

Certainly, the above-mentioned statement is merely an example, when it comes to prosecution, the number of selector circuits is not necessarily limited to two, and the number of connectors with which each selector circuit can couple is not limited by the example taken by the above-mentioned statement. Moreover, as stated above, the kind and the number of connectors are not limited by the foregoing embodiments, that is to say, each of the connectors can be either a male-connector or a female-connector and the location where these connectors are disposed is not limited to both sides of the adapter.

To summarize the foregoing statement, the adapter of the present invention comprises at least the following advantages:

1. The adapter of the present invention can transfer between RJ-45 wire connections and RJ-11 wire connections.
2. Therefore, the adapter of the present invention can omit the unnecessary connector design and further to leave room for more available space in the computer internal area for disposing connectors without increasing the size on the internal hardware design of the computer.

The invention has been described using a couple of exemplary preferred embodiments. However, it is to be understood that the scope of the invention is not limited to the disclosed embodiment. On the contrary, it is intended to cover various modifications and similar arrangements. The scope of the claims, therefore, should be accorded the broadest interpretation so as to encompass all such modifications and similar arrangements.

What is claimed is:

1. An adapter comprising:

at least a first type data transmission port for connecting a first data transmission device that uses at least a first type data transmission connector; and at least a second type data transmission port for connecting a second data transmission device that uses at least a second type data transmission connector;

wherein at least one of the first type data transmission ports is electrically coupled with at least one of the second type data transmission ports for transmission of data therebetween.

2. The adapter of claim 1 wherein the first data transmission device is used with either a local area network or an internet.

3. The adapter of claim 1 wherein the second data transmission device is used with a Home PNA (Home Phone Line Networking Alliance) device.

4. The adapter of claim 1 wherein the second type data transmission port is for connecting to a modem.

5. The adapter of claim 1, wherein the first type transmission port is eight-conductor and the second type transmission port is four-conductor.

6. The adapter of claim 5 wherein the first and second type data transmission ports are both of the same sex.

7. The adapter of claim 1, further comprising:

at least one selector circuit for reconfiguring the electrical coupling between the at least one of the first type data transmission ports and the at least one of the second type data transmission ports.

8. An adapter comprising:

a first type data transmission port for connecting a first data transmission device that uses a first type data transmission connector;

and a plurality of second type data transmission ports for connecting a second data transmission device that uses at least a second type data transmission connector;

wherein the first type data transmission port is electrically coupled with at least one of the second type data transmission ports for transmission of data therebetween.

9. The adapter of claim 8 wherein the first data transmission device is used with either a local area network or an internet.

10. The adapter of claim 8 wherein the second data transmission device is used with a Home PNA device.

11. The adapter of claim 8 wherein the second type data transmission port is for connecting to a modem.

12. The adapter of claim 8, wherein the first type transmission port is eight-conductor and the second type transmission port is four-conductor.

13. The adapter of claim 12, wherein the first and second type data transmission ports are both of the same sex.

14. The adapter of claim 8, further comprising:

at least one selector circuit for reconfiguring the electrical coupling between the first type data transmission port and the at least one of the second type data transmission ports.

15. An adapter comprising:

a plurality of first type data transmission ports for connecting a first data transmission device that uses at least a first type data transmission connector; and a second type data transmission port for connecting a second data transmission device that uses a second type data transmission connector;

wherein the second type data transmission port is electrically coupled with at least one of the first type data transmission ports for transmission of data therebetween.

16. The adapter of claim 15 wherein the first data transmission device is used with either a local area network or an internet.

17. The adapter of claim 15 wherein the second data transmission device is used with a Home PNA device.

18. The adapter of claim 15 wherein the second type transmission port is for connecting to a modem.

19. The adapter of claim 15, wherein the first type transmission port is eight-conductor and the second type transmission port is four-conductor.

20. The adapter of claim 19, wherein the first and second type data transmission ports are both of the same sex.

21. The adapter of claim 15, further comprising:

at least one selector circuit for reconfiguring the electrical coupling between the at least one of the first type data transmission ports and the second type data transmission port.

* * * * *